United States Patent [19]

Compton

[11] 4,148,358

[45] Apr. 10, 1979

[54] OXIDIZING HYDROCARBONS, HYDROGEN, AND CARBON MONOXIDE

[75] Inventor: Leslie E. Compton, Claremont, Calif.

[73] Assignee: Occidental Research Corporation, Irvine, Calif.

[21] Appl. No.: 861,238

[22] Filed: Dec. 16, 1977

[51] Int. Cl.[2] ..... E21B 43/24; E21B 43/26

[52] U.S. Cl. ..... 166/256; 166/259; 165/45; 299/2; 423/245; 423/246; 423/248

[58] Field of Search ..... 299/2-5, 299/7; 166/256, 259, 260, 300, 265-267; 423/245, 246, 248; 165/45; 208/11 R

[56] References Cited

U.S. PATENT DOCUMENTS

| | | | |
|---|---|---|---|
| Re. 29,553 | 2/1978 | Burton et al. | 166/256 X |
| 3,294,167 | 12/1966 | Vogel | 166/258 X |
| 3,454,958 | 7/1969 | Parker | 166/256 |
| 3,661,423 | 5/1972 | Garrett | 299/13 X |
| 3,994,343 | 11/1976 | Cha et al. | 166/259 |
| 4,005,752 | 2/1977 | Cha | 299/2 |
| 4,014,575 | 3/1977 | French et al. | 299/2 |

*Primary Examiner*—Stephen J. Novosad

[57] ABSTRACT

The hydrocarbon, hydrogen and carbon monoxide concentration of a gas is reduced by reacting these constituents in the gas with oxygen in the presence of a fragmented permeable mass of combusted oil shale.

16 Claims, 1 Drawing Figure

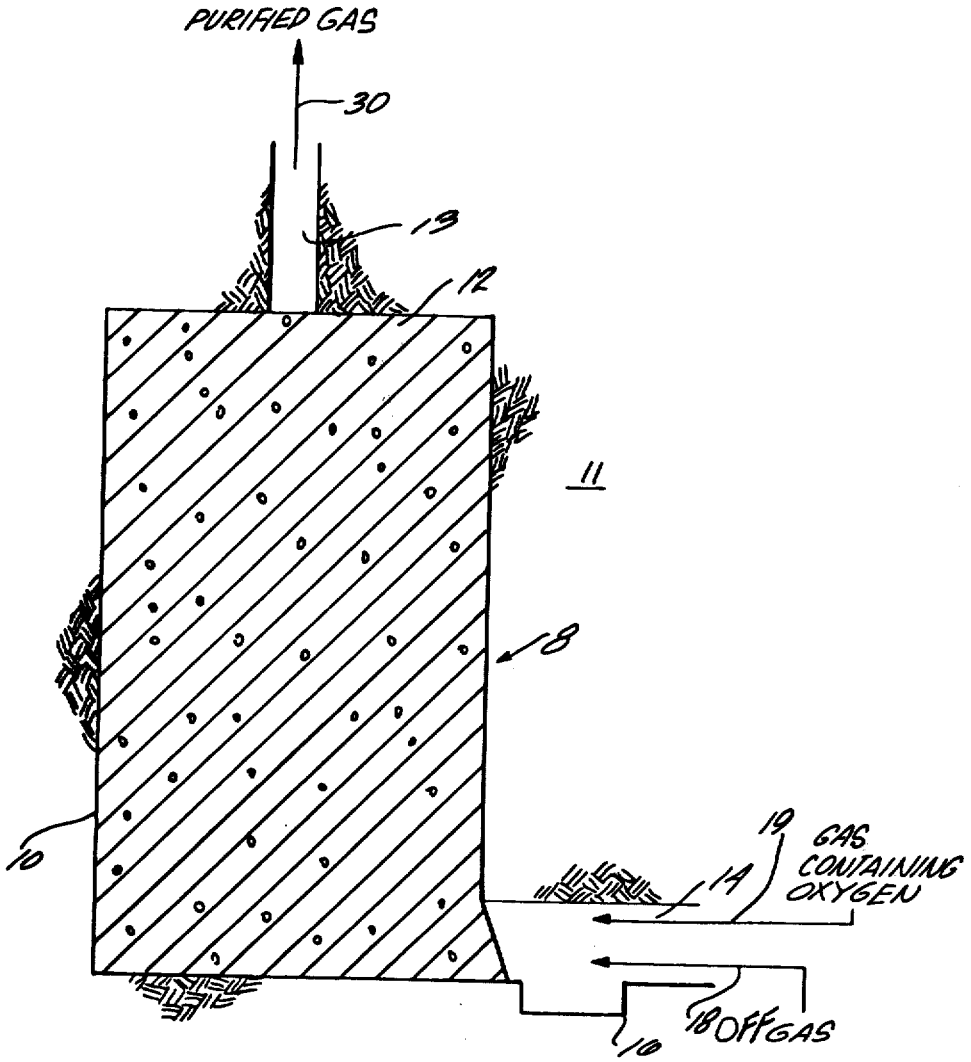
PURIFIED GAS
30
13
12
11
8
10
19
GAS CONTAINING OXYGEN
14
18 OFF GAS
16

OXIDIZING HYDROCARBONS, HYDROGEN, AND CARBON MONOXIDE

CROSS-REFERENCES

This application is related to U.S. patent application Ser. No. 780,928 filed on Mar. 24, 1977, now U.S. Pat. No. 4,082,146 entitled Low Temperature Oxidation of Hydrogen Sulfide in the Presence of Oil Shale, in the name of Leslie E. Compton and William H. Rowan; U.S. patent application Ser. No. 780,924, filed on Mar. 24, 1977 now U.S. Pat. No. 4,086,963 entitled Decreasing Hydrogen Sulfide Concentration Of A Gas, in the name of Chang Yul Cha; U.S. patent application Ser. No. 780,926, filed on Mar. 24, 1977, entitled Removing Hydrogen Sulfide From A Gas, in the name of Leslie E. Compton; U.S. patent application Ser. No. 780,927, filed on Mar. 24, 1977, now U.S. Pat. No. 4,086,963 entitled Oxidizing Hydrogen Sulfide in the name of Leslie E. Compton; and U.S. patent application Ser. No. 861,237 filed on Dec. 16, 1977, entitled Decreasing Hydrocarbon, Hydrogen and Carbon Monoxide Concentration of a Gas, filed by Chang Yul Cha. Each of these patent applications is incorporated herein by reference.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit interspersed with layers containing an organic polymer called "kerogen", which upon heating decomposes to produce carbonaceous liquid and gaseous products. It is the formation containing kerogen that is called "oil shale" herein, and the liquid product is called "shale oil". A number of methods have been developed for processing the oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application and incorporated herein by reference. This patent describes in situ recovery of liquid and gaseous carbonaceous materials from a subterranean formation containing oil shale by explosively expanding and fragmenting such formation to form a stationary, fragmented, permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing "retorted oil shale".

One method of supplying hot retorting gases used for converting kerogen contained in the oil shale, as described in U.S. Pat. No. 3,661,423, includes establishment of a combustion zone in the retort and movement of an oxygen supplying gaseous feed mixture as a combustion zone feed into the combustion zone to advance the combustion zone through the retort. In the combustion zone oxygen in the gaseous feed mixture is depleted by reaction with hot carbonaceous materials to produce heat and a combustion gas. By the continued introduction of the oxygen supplying gaseous feed mixture into the combustion zone, the combustion zone is advanced through the retort.

The combustion gas and the portion of the gaseous feed mixture which does not take part in the combustion process pass through the retort on the advancing side of the combustion zone to heat the oil shale in a retorting zone to a temperature sufficient to produce kerogen decomposition, called retorting, in the oil shale to gaseous and liquid products and a residue of solid carbonaceous material.

The liquid products and gaseous products are cooled by the cooler oil shale fragments in the retort on the advancing side of the retorting zone. The liquid carbonaceous products, together with water produced in or added to the retort, are withdrawn from the retort on the advancing side of the retorting zone. An off gas containing combustion gas generated in the combustion zone, gaseous products of the retorting zone, gas from carbonate decomposition, and the portions of gaseous feed mixture which do not take part in the combustion process is also withdrawn from the retort on the advancing side of the retorting zone.

The off gas, which can contain nitrogen, hydrogen, carbon monoxide, carbon dioxide, methane, water vapor, hydrocarbons, such as methane, ethane, ethylene, propane, propylene and higher hydrocarbons, water vapor and sulfur compounds such as hydrogen sulfide, must be disposed of in an ecologically sound manner. This is primarily because its low fuel value, i.e., less than about 70 BTU per standard cubic foot, can make it uneconomical to use as a fuel. Added to this is the difficulty encountered in initiating and maintaining combustion of fuels with such a low BTU content. Since environmental considerations prohibit discharge of such gas directly to the atmosphere, there is an outstanding need for an economical method of purifying the off gas generated from an in situ oil shale retort.

The present invention is addressed to this problem and, as will be described in greater detail hereafter, is able to accomplish such purification while taking advantage of the heretofore wasted sensible heat remaining in an in situ oil shale retort at the conclusion of the retorting operation.

SUMMARY OF THE INVENTION

According to a method of this invention the hydrocarbon, hydrogen and carbon monoxide concentration of a gas is reduced by reacting the gas with oxygen in the presence of a fragmented permeable mass of combusted oil shale to yield gas containing a relatively lower hydrocarbon, hydrogen and carbon monoxide concentration. It is believed that the combusted oil shale has a catalytic effect on the oxidation of the hydrocarbons, hydrogen and carbon monoxide to carbon dioxide and water. This belief is based on the surprising discovery that these oxidation reactions can be conducted at temperatures much lower than heretofore thought possible. Such gas with relatively lower hydrocarbon, hydrogen and carbon monoxide concentration is then withdrawn from the fragmented permeable mass of combusted oil shale.

In another aspect of the present invention the carbon dioxide generated by the oxidation of the hydrocarbons and carbon monoxide reacts with alkaline earth metal oxides present in the combusted oil shale to produce solid alkaline earth metal carbonates thereby further reducing disposal problems.

DRAWING

These and other features, aspects and advantages of the present invention will become more apparent with respect to the following description, appended claims, and accompanying drawing which is a schematic representation in vertical cross section of an in situ oil shale retort containing combusted oil shale being used for oxidizing hydrocarbons, hydrogen and carbon monoxide contained in a gas stream.

DESCRIPTION

Referring to the drawing, an already retorted in situ oil shale retort 8 is shown in the form of a cavity 10 formed in an unfragmented subterranean formation 11 containing oil shale. The cavity contains an expanded or fragmented permeable mass 12 of formation particles. The cavity 10 can be created simultaneously with fragmentation of the mass of formation particles 12 by blasting by any of a variety of techniques. Methods of forming an in situ oil retort are described in U.S. Pat. Nos. 3,661,423, 4,043,595, 4,043,596, 4,043,597, and 4,043,598. Other techniques may also be used.

A conduit 13 communicates with the top of the fragmented mass of formation particles. During the retorting operation of the retort 8, a combustion zone is established in the retort and advanced by introducing a gaseous feed containing an oxygen supplying gas, such as air or air mixed with other gases, into the in situ oil shale retort through the conduit 13. As the gaseous feed is introduced to the combustion zone, oxygen oxidizes carbonaceous material in the oil shale to produce combusted oil shale and combustion gas. Heat from the exothermic oxidation reactions, carried by flowing gases, advances the combustion zone through the fragmented mass of particles.

Combustion gas produced in the combustion zone, any unreacted portion of the oxygen supplying gaseous feed and gas from carbonate decomposition are passed through the fragmented mass of particles on the advancing side of the combustion zone to establish a retorting zone on the advancing side of the combustion zone. As oil shale is retorted in the retorting zone, kerogen is converted to liquid and gaseous products including hydrocarbons.

There is a drift 14 in communication with the bottom of the retort. The drift contains a sump 16 in which liquid products are collected to be withdrawn for further processing. An off gas containing gaseous products, combustion gas, gases from carbonate decomposition, and any unreacted portion of the oxygen supplying gaseous feed is also withdrawn from the in situ oil shale retort 8 by way of the drift 14. The off gas can contain large amounts of nitrogen with lesser amounts of hydrogen, carbon monoxide, carbon dioxide, methane, ethane, ethylene, propane, propylene, higher hydrocarbons, water vapor, and sulfur compounds such as hydrogen sulfide. The off gas also can contain particulates and hydrocarbon containing aerosols. It is desirable to remove as much of the hydrocarbons, hydrogen and carbon monoxide content of the off gas as possible.

The retort illustrated in the drawing has had retorting and combustion operations completed and contains a combusted, fragmented permeable mass of formation particles containing oil shale. Such a retort can be referred to as "spent." As used herein, the term "retorted oil shale" refers to oil shale heated to a sufficient temperature to decompose kerogen in an environment substantially free of free oxygen so as to leave a solid carbonaceous residue. The term "combusted oil shale" refers to oil shale of reduced carbon content due to oxidation by a gas containing free oxygen. The term "treated oil shale" refers to oil shale treated to remove organic materials and includes retorted and/or combusted oil shale. An individual particle containing oil shale can have a core of retorted oil shale and an outer "shell" of combusted oil shale. Such can occur when oxygen has diffused only partly way through the particle during the time it is at an elevated temperature and in contact with an oxygen supplying gas.

A gas stream 18 containing hydrocarbons, hydrogen and carbon monoxide such as off gas from an active oil shale retort and a gas stream 19 containing oxygen, such as air are introduced concurrently through the drift 14 to the already treated retort 8. It will be understood that although the "oxygen containing gas" is ordinarily ambient air, other composition variations are included within the term. Thus, for example, if desired, pure oxygen or air augmented with additional oxygen can be used so that the partial pressure of oxygen is increased. Similarly, air can be diluted with an oxygen free gas such as nitrogen. The off gas and oxygen containing gas can be introduced separately into the retort or can be substantially homogeneously mixed prior to introduction into the retort. Mixing can be accomplished by any of a number of methods such as jet mixers, injectors, fans and the like.

Preferably the off gas and the oxygen containing gas are introduced to the hottest portion of the fragmented permeable mass in the retort to minimize pressure drop through the retort and the cost of passing gas through the retort. By introducing the gases to the hottest portion of the retort, heat is transferred by the flowing gases to the cooler portions of the retort, with the result that the fragmented permeable mass eventually has a substantially uniform temperature gradient, and no exceptionally hot region, with the temperature decreasing in the direction of movement of the gases. This results in reduced pressure drop across the retort because the volumetric flow rate of the gases through the retort decreases as the temperature of the fragmented mass decreases. Also, the void fraction of the fragmented permeable mass increases due to thermal contraction of the formation particles as the mass of particles cools. Thus, the cross sectional area available for flow of gases through the retort increases.

Therefore, as shown in the drawing, when a fragmented permeable mass in an in situ oil shale retort is retorted from top to bottom, preferably the off gas and the oxygen containing gas are introduced to the bottom of the retort, and purified effluent gas is withdrawn from the top of the retort. An advantage of introducing the gas to the bottom of the retort, as shown in the drawing, is that off gas from the bottom of an adjacent active retort can be directly introduced to the bottom of the spent retort 8 without having to incur the capital and operating expenses of transferring the off gas to the surface.

For economy, the conduit used for introducing oxygen supplying gaseous feed to the retort 8 during the retorting operation is utilized to withdrawn effluent gas 30 of reduced hydrocarbon, hydrogen and carbon monoxide content from the retort. Similarly, the drift 14 used for withdrawing gaseous products from the retort 8 during the retorting operation is utilized to introduce hydrocarbon, hydrogen and carbon monoxide containing gas 18 and oxygen containing gas 19 to the retort. The effluent gas 30 has a relatively lower hydrocarbon, hydrogen and carbon monoxide content than the gas 18 introduced into the retort 8.

As the hydrocarbon, hydrogen and carbon monoxide containing gas stream 18 and the oxygen containing gas stream 19 pass through the spent retort, hydrocarbons are oxidized to carbon dioxide and water, hydrogen is oxidized to water, and carbon monoxide is oxidized to carbon dioxide. Although not essential, it is preferred that there be a stoichiometric excess of oxygen.

Surprisingly, it has been found that in the presence of combusted oil shale and under the conditions described hereinafter, the oxidation of the hydrocarbons, hydrogen and carbon monoxide will commence at temperatures as low as about 600° F. Moreover, at 700° F. 99% of the hydrogen, 98% of the methane and 99.6% of the ethane are combusted; and, at 850° F. 92% of the carbon monoxide was oxidized. Trace levels of $C_3$ to $C_5$ hydrocarbons were also reduced at 850° F. These findings are particularly surprising because these constituents were heretofore not oxidized at temperatures lower than their spontaneous ignition temperatures without the use of a catalyst. By way of example, the lowest ignition temperature of hydrogen in pure oxygen is 842° F. (450° C.) and the lowest ignition temperature of carbon monoxide in pure oxygen is 1094° F. (590° C.), (*Lange's Handbook of Chemistry,* Eleventh Edition, Edited by John A. Dean, McGraw-Hill Book Company). Since in off gas the hydrogen and carbon monoxide are mixed and conditions in an in situ retort are less than ideal, higher ignition temperatures would be expected. It was also not expected that combusted oil shale would function as a catalyst and promote these oxidation reactions. Thus the present invention provides for substantial reduction of the hydrocarbon, hydrogen and carbon monoxide concentration of a gas such as the off gas from an in situ oil shale retort to be accomplished at temperatures below the spontaneous ignition temperature preferably from about 600° F. to about 1000° F., and most preferably about 600° F. to about 850° F. by oxidation in the presence of combusted oil shale.

Oil shale contains large quantities of alkaline earth metal carbonates, principally calcium and magnesium carbonates, which during retorting and combustion are at least partly calcined to produce alkaline earth metal oxides. Thus combusted oil shale particles in the retort 8 can contain approximately 20 to 30% calcium oxide and 5 to 10% magnesium oxide, with smaller quantities of less reactive oxides present.

The carbon dioxide and sulfur dioxide produced from the reactions can combine with these constituents of the oil shale to yield solid materials such as carbonates, sulfites and sulfates. For example, as the reaction gases pass through the retort, carbon dioxide in the gas can combine in the presence of water with the oxides of calcium and magnesium to form the corresponding carbonates. Similarly, the oxides of sulfur present in the gas can combine in the presence of water with the oxides of calcium and magnesium to form calcium and magnesium sulfites and then sulfates. Exemplary of the initial reactions which can occur are the following:

$$MO + CO_2 \rightarrow MCO_3$$

$$MO + SO_2 \rightarrow MSO_3$$

where M represents an alkaline earth metal. Water present in the retort is expected to enhance the rates of reaction of carbon dioxide and sulfur dioxide with alkaline earth metal oxides. Although not essential it is preferred that the fragmented permeable mass of hot oil shale has a stoichiometric excess of alkaline earth metal oxides relative to the carbon dioxide, and sulfur dioxide formed by combining the hydrocarbon, hydrogen, carbon monoxide and hydrogen sulfide constituents of the off gas with oxygen. Thus a substantial portion of the carbon dioxide resulting from the oxidation of the hydrocarbons and carbon monoxide and the sulfur dioxide resulting from oxidation of hydrogen sulfide can be removed from the gas passing through the retort, especially with high temperatures in the mass of particles in the retort and at high molar ratios of alkaline earth metal oxides to carbon dioxide and sulfur dioxide.

The direct reactions between carbon dioxide and sulfur dioxide and calcium or magnesium oxide to form carbonates, sulfites and sulfates occurs slowly at ambient temperature; however, at temperatures of about 600° F. to about 1800° F. which can exist in the upstream portion of a spent retort, short reaction times occur. From a practical standpoint the maximum temperatures for these reactions in the presence of oil shale is the fusion temperature of oil shale, which is about 2200° F. Generally, sufficient alkaline earth metal oxides are present in a retort to remove substantial portions of the carbon dioxide and sulfur dioxide formed from oxidation of the hydrocarbons, hydrogen, carbon monoxide and hydrogen sulfide in off gas generated from retorting oil shale in a retort of comparable size. For example, retorting one ton of oil shale particles can yield 750 pounds of alkaline earth metal oxides.

The gas stream 30 withdrawn from a retort 8 has a relatively lower hydrocarbon, hydrogen and carbon monoxide concentration than the gas 18 introduced into the retort due to oxidation thereof in the retort. It also can have a lower total sulfur compound content because of solid sulfur deposited on the mass of oil shale particles in the retort.

The efficiencies and economics of the invention can be enhanced by recovering the heat generated by the combustion of the hydrocarbons, hydrogen and carbon monoxide for process use or power generation. If the purification of the off gas occurs directly in an in situ retort the heat can be recovered by means of heat exchangers or other apparatus (not shown) either in the retort or adjacent to the conduit 13. In another embodiment the off gas, or a portion thereof from an in situ oil shale retort can be channeled to the surface and reacted with the oxygen containing gas in the presence of combusted oil shale in an above ground process vessel (not shown) containing heat exchange tubes or similar apparatus.

The method of this invention has many advantages over prior art processes. By using combusted oil shale to remove hydrocarbons, hydrogen and carbon monoxide from gas streams such as off gas from an in situ oil shale retort, the purchase of a hydrocarbon, hydrogen and carbon monoxide absorbent or adsorbent is avoided. Furthermore, when combusted oil shale contained in an in situ oil shale retort is used, the oil shale remains in the ground, thereby eliminating disposal problems. In addition, vast quantities of oil shale are available. Thus regeneration of oil shale, even if its activity is greatly reduced, in unnecessary. A long residence time of the hydrocarbon, hydrogen and carbon monoxide containing gas and gaseous source of oxygen can be utilized to achieve high conversion.

The following controls and examples demonstrate the efficacy of combusted oil shale in promoting the oxidation of hydrocarbons, hydrogen and carbon monoxide at low temperatures.

EXAMPLES

A mixture of carbon monoxide, hydrogen, methane, ethane, ethylene, propylene and trace $C_4$ and $C_5$ hydrocarbons approximating the percentages found in the off gas produced from the in situ retorting of oil shale was channeled through a 7 inch high reactor with a 1 inch diameter bed of combusted oil shale having a particle size in the range of from about −3 to about +8 mesh at a superficial flow rate of 6 SCFM per square foot of oil shale bed. A first run was made with the oil shale bed heated to 700° F. and a second run was made with the bed at 850° F. In both instances the residence time of the mixture in the oil shale bed was about 3 seconds. The following table shows the results of these experiments.

TABLE I

| | Temp. | $C_4$ | $C_5$+ | $C_2H_4$ | $C_2H_6$ | $CH_4$ | $C_3H_6$ | CO | $H_2$ |
|---|---|---|---|---|---|---|---|---|---|
| | ° F. | | | | Vol. % | | | | |
| Inlet | 700 | 0.002 | 0.020 | 0.028 | 0.78 | 2.15 | 0.006 | 2.95 | 4.33 |
| Outlet | | 0.002 | 0.020 | 0.026 | 0.003 | 0.044 | 0.006 | 1.05 | 0.044 |
| Inlet | 850 | 0.003 | 0.023 | 0.042 | 0.789 | 2.17 | 0.012 | 2.994 | 4.44 |
| Outlet | | 0.002 | 0.019 | 0.029 | 0.004 | 0.000 | 0.003 | 0.233 | 0.057 |

Although this invention has been described in considerable detail with reference to certain versions thereof, other versions of the invention are within the scope of this invention. Thus the spirit and scope of the appended claims should not necessarily be limited to the description of the preferred embodiments.

What is claimed is:

1. A method for recovering gaseous products from a first in situ oil shale retort in a subterranean formation containing oil shale, said first in situ retort containing an explosively expanded and fragmented permeable mass of particles containing oil shale and having a combustion zone and a retorting zone advancing therethrough, the method comprising the steps of:

(a) introducing into the first in situ oil shale retort on the trailing side of the combustion zone a combustion zone feed comprising oxygen to advance the combustion zone through the fragmented mass of particles and produce combustion gas in the combustion zone;

(b) passing said combustion gas and any unreacted portion of the combustion zone feed through a retorting zone in the fragmented mass of particles on the advancing side of the combustion zone, wherein oil shale is retorted and gaseous products, including hydrocarbons, are produced;

(c) withdrawing an off gas comprising said gaseous products, combustion gases and any gaseous unreacted portion of the combustion zone feed, and including hydrocarbons, hydrogen and carbon monoxide from the first in situ oil shale retort from the advancing side of the retorting zone; and (d) reducing the hydrocarbon, hydrogen and carbon monoxide concentration of such off gas by the steps of:

(i) introducing at least a portion of the off gas from the first retort into a second in situ oil shale retort in a subterranean formation containing a fragmented permeable mass of formation particles containing combusted oil shale;

(ii) concurrently introducing oxygen containing gas into the second retort for reacting oxygen in the oxygen containing gas with the hydrocarbons, hydrogen and carbon monoxide in the introduced off gas in the presence of combusted oil shale in the second retort to yield gas having a hydrocarbon, hydrogen and carbon monoxide concentration relatively lower than the hydrocarbon, hydrogen and carbon monoxide concentration of the introduced off gas; and (iii) withdrawing from the second retort such gas having relatively lower hydrocarbon, hydrogen and carbon monoxide concentration.

2. A method of decreasing the hydrocarbon, hydrogen and carbon monoxide concentration of a gas comprising the steps of:

introducing a gas containing relatively higher hydrocarbon, hydrogen and carbon monoxide concentration to a fragmented permeable mass of particles containing combusted oil shale, wherein at least a portion of the oil shale contains alkaline earth metal oxides;

reacting the hydrocarbons, hydrogen and carbon monoxide in the introduced gas with oxygen in the presence of the combusted oil shale to yield carbon dioxide and a gas having a lower hydrocarbon, hydrogen and carbon monoxide concentration than the introduced gas; reacting at least a portion of the carbon dioxide with at least a portion of the alkaline earth metal oxides; and, withdrawing gas having relatively lower concentration of hydrocarbons, hydrogen and carbon monoxide from the fragmented permeable mass.

3. The method of claim 2 wherein the fragmented permeable mass of particles contains combusted oil shale having a temperature of from about 600° F. to about 1000° F.

4. The method of claim 2 in which the fragmented mass contains combusted oil shale having a temperature of from about 600° F. to about 850° F.

5. The method of claim 2 in which the temperature of the fragmented permeable mass of particles containing combusted oil shale is less than the spontaneous ignition temperature of the gas having a relatively higher concentration of hydrocarbons, hydrogen and carbon monoxide.

6. A method of decreasing the hydrocarbon, hydrogen and carbon monoxide concentration of gas comprising the steps of:

introducing gas containing relatively higher hydrocarbon, hydrogen and carbon monoxide concentration into an in situ oil shale retort in a subterranean formation containing oil shale, said in situ retort containing a fragmented permeable mass of formation particles containing combusted oil shale and alkaline earth metal oxides;

concurrently introducing oxygen containing gas into the retort for reacting oxygen in the oxygen containing gas with hydrocarbons, hydrogen and carbon monoxide in the gas of relatively higher hydrocarbon, hydrogen and carbon monoxide concentration in the presence of combusted oil shale in the retort to produce carbon dioxide and a gas having a hydrocarbon, hydrogen and carbon monoxide concentration relatively lower than the hydrocarbon, hydrogen and carbon monoxide concentration of the introduced gas; reacting at least a portion of the carbon dioxide with at least a portion of the alkaline earth metal oxides; and, withdrawing gas having a relatively lower hydrocarbon, hydrogen and carbon monoxide concentration from the first retort.

7. The method of claim 6 wherein the fragmented permeable mass of particles contains combusted oil shale having a temperature of from about 600° F. to about 1000° F.

8. The method of claim 7 in which the temperature is from about 600° F. to about 850° F.

9. The method of claim 6 in which the gas containing relatively higher hydrocarbon, hydrogen and carbon monoxide concentration comprises gas from a second in situ oil shale retort, and wherein formation particles in the first retort contacted by the gas are at a temperature less than the spontaneous ignition temperature of the gas.

10. The method of claim 6 in which the temperature of the fragmented permeable mass of particles containing combusted oil shale is less than the spontaneous ignition temperature of the gas having a relatively higher concentration of hydrocarbons, hydrogen and carbon monoxide.

11. A method for decreasing hydrocarbon, hydrogen and carbon monoxide concentration of a gas stream from an in situ oil shale retort comprising the steps of:

forming carbon dioxide by combining the gas stream with oxygen in the presence of a fragmented permeable mass of particles containing combusted oil shale, wherein at least a portion of the combusted oil shale contains alkaline earth metal oxides for combining with the formed carbon dioxide.

12. The method of claim 11 wherein the fragmented permeable mass has a stoichiometric excess of alkaline earth metal oxides relative to the carbon dioxide formed by combining the hydrocarbons, hydrogen and carbon monoxide constituents of the off gas with oxygen.

13. A method for removing hydrocarbons, hydrogen and carbon monoxide from a gas stream comprising the steps of:

forming a first in situ oil shale retort in a subterranean formation containing oil shale, said first in situ retort containing a fragmented permeable mass of formation particles containing oil shale and alkaline earth metal carbonates;

producing combusted oil shale in the first retort by introducing a gaseous combustion zone feed comprising an oxygen supplying gas into a combustion zone in the fragmented mass for advancing the combustion zone through the fragmented mass of particles and producing combustion gas and combusted oil shale and converting at least a portion of the alkaline earth metal carbonates to corresponding alkaline earth metal oxides;

thereafter, contacting, in the presence of oxygen, combusted oil shale particles at a temperature greater than about 600° F. in the first in situ retort with a process gas with relatively higher hydrocarbon, hydrogen and carbon monoxide concentration to form carbon dioxide and water, wherein at least a portion of the formed carbon dioxide combines with alkaline earth metal oxides contained in the first retort to yield gas having a hydrocarbon, hydrogen and carbon monoxide concentration relatively lower than the hydrocarbon, hydrogen and carbon monoxide concentration of the process gas; and withdrawing gas with relatively lower hydrocarbon, hydrogen and carbon monoxide concentration from the first in situ oil shale retort.

14. The method of claim 13 in which the gas containing relatively higher hydrocarbon, hydrogen and carbon monoxide concentration comprises off gas from a second in situ oil shale retort.

15. A method for generating useful heat from the gas produced by the retorting of an in situ oil shale retort comprising the steps of introducing the gas to a reaction zone comprising a fragmented permeable mass of particles containing combusted oil shale and heat exchange means; and, concurrently introducing an oxygen containing gas to the reaction zone and reacting the oxygen in the oxygen containing gas with at least one constituent of the gas; and transferring the heat of the reaction from the reaction zone through the heat exchange means.

16. A method for generating useful heat from a gas produced by the retorting of an in situ oil shale retort, said gas comprising the steps of introducing the gas to a vessel containing a fragmented permeable mass of particles containing combusted oil shale and heat exchange means; concurrently introducing an oxygen containing gas to the vessel; reacting the oxygen in the oxygen containing gas with at least a portion of the hydrocarbons, hydrogen and carbon monoxide in the gas produced by the retorting of an in situ oil shale retort; and, transferring the heat of the reaction from the vessel through the heat exchange means.

* * * * *